US007308954B2

(12) United States Patent
Martin-Marshall

(10) Patent No.: US 7,308,954 B2
(45) Date of Patent: Dec. 18, 2007

(54) ROTATING DIVERTER HEAD

(75) Inventor: Peter Stewart Martin-Marshall, Aberdeen (GB)

(73) Assignee: Stacey Oil Services, Ltd., Aberdeen (GB)

( * ) Notice: Subject to any disclaimer, the term of this patent is extended or adjusted under 35 U.S.C. 154(b) by 237 days.

(21) Appl. No.: 10/516,489

(22) PCT Filed: Jun. 2, 2003

(86) PCT No.: PCT/GB03/02394

§ 371 (c)(1),
(2), (4) Date: Jan. 7, 2005

(87) PCT Pub. No.: WO03/104609

PCT Pub. Date: Dec. 18, 2003

(65) Prior Publication Data

US 2005/0236158 A1 Oct. 27, 2005

(30) Foreign Application Priority Data

Jun. 7, 2002 (GB) ..... 0213069.8

(51) Int. Cl.
*E21B 21/00* (2006.01)
*E21B 21/06* (2006.01)

(52) U.S. Cl. ..... 175/207; 175/220; 175/57

(58) Field of Classification Search ..... 166/379, 166/85.4; 175/195, 57, 207, 220
See application file for complete search history.

(56) References Cited

U.S. PATENT DOCUMENTS

| | | | |
|---|---|---|---|
| 4,312,404 A | 1/1982 | Morrow | |
| 5,305,839 A | 4/1994 | Kalsi et al. | |
| 5,662,181 A | 9/1997 | Williams et al. | |
| 6,230,824 B1 * | 5/2001 | Peterman et al. | 175/214 |

* cited by examiner

*Primary Examiner*—David Bagnell
*Assistant Examiner*—Brad Harcourt
(74) *Attorney, Agent, or Firm*—Keaty Professional Law Corporation

(57) ABSTRACT

A rotating diverter head for use on a blow out preventer stack of an oil, gas or geothermal well. While providing for sealing and rotation of a drill pipe through the head, the head additional includes a flange on which the head is rotatable. The flange connects the head to the stack whereupon it can be rotated to align a return flow line before being locked in position.

22 Claims, 4 Drawing Sheets

ROTATING DIVERTER HEAD

The present invention relates equipment used in the drilling of oil, gas and geothermal wells and in particular, though not exclusively, to a rotating diverter head which includes an inlet flange on which the head can rotate to adjust the location of a side outlet.

In drilling a well, a drilling tool or "drill bit" is rotated under an axial load within a bore hole. The drill bit is attached to the bottom of a string of threadably connected tubulars or "drill pipe" located in the bore hole. The drill pipe is rotated at the surface of the well by an applied torque which is transferred by the drill pipe to the drill bit. As the bore hole is drilled, the hole bored by the drill bit is substantially greater than the diameter of the drill pipe. To assist in lubricating the drill bit, drilling fluid or gas is pumped down the drill pipe. The fluid jets out of the drill bit, flowing back up to the surface through the annulus between the wall of the bore hole and the drill pipe.

The density of the drilling fluid is adjusted such that the pressure head produced by the weight of the column of drilling fluid is slightly more or less than the pressure of the oil or gas encountered in the geological formations being drilled through. If the pressure head of the column of drilling fluid is greater than the pressure of the oil or gas, the top of the well can be open to atmosphere. It is often advantageous to allow the pressure head of the drilling fluid to be slightly less than the pressure of the oil or gas encountered in the formation. In this case, known as "underbalanced drilling", the annulus around the drill pipe needs to be sealed and the drilling fluid returning under pressure up the annulus must be diverted to a recirculating unit for pumping back down the well.

Rotating diverter heads provide a means of sealing off the annulus around the drill pipe as the drill pipe rotates and translates axially down the well while including a side outlet through which the return drilling fluid is diverted. Such rotating diverter heads may also be referred to as rotating blow out preventers or drilling heads. These units generally comprise a stationary housing or bowl including a side outlet for connection to a fluid return line and an inlet flange for locating the unit on a blow out preventer or other drilling stack at the surface of the well bore. Within the bowl, opposite the inlet flange, is arranged a rotatable assembly such as anti-friction bearings which allow the drill pipe, located through the head, to rotate and slide. The assembly includes a seal onto the drill pipe which is typically a strip of rubber.

Prior art rotatable diverter heads such as those disclosed in U.S. Pat. Nos. 4,949,796, 5,662,181, 5,848,643, 5,647,444, 4,480,703 and 4,312,404 have concentrated on improvements to the sealing means, in particular the ease to which the rubber strips can be replaced. In all these diverter heads the side outlet is included in the housing of the stationary bowl and the rotatable assemblies are mounted above the side outlet to aid disassembly for maintenance.

A disadvantage of these prior art diverter heads is that as the bowl is bolted or clamped to the blow out preventer, the side outlet is fixed at a single position. The pipework forming the return fluid line must attach to the side outlet and as both are generally fixed in position and orientation it is difficult to mate their respective flanges together.

It is therefore an object of the present invention to provide a rotating diverter head which can be rotated to re-position the side outlet with respect to the inlet flange.

It is a further object of the present invention to provide an improved method of connecting a rotating diverter head to a return fluid line at a blow out preventer.

According to a first aspect of the present invention there is provided a rotating diverter head comprising:

a bowl member having a first bore aligned on a central axis therethrough and a second bore located substantially transverse of the central axis;

a housing located substantially within the bowl member including first rotational means to rotate the housing relative to the bowl member and first sealing means to sealably engage the housing upon a drill pipe when the drill pipe is inserted through the first bore; and an inlet flange for connecting the bowl member to a blow out preventer stack, the flange including second rotational means to selectively rotate the bowl member about the central axis.

By allowing the bowl member to rotate relative to the inlet flange and hence the blow out preventer stack, the second bore can be rotated on the central axis to aid alignment with a return flow line.

Preferably the second rotational means comprises interconnected screw threads between the flange and the bowl member.

Preferably also the flange further includes second sealing means to prevent the egress of fluid from the first bore through the second rotational means. The second sealing means may be an o-ring or other rubber based seal.

Preferably the flange further includes locking means for preventing rotational movement of the bowl member with respect to the flange when the second bore is aligned. Advantageously the locking means comprises a locking ring arranged around the bowl member and engageable on the screw threads.

Preferably the housing including first sealing means and first rotational means is as known in the art. Examples of such housings are disclosed in U.S. Pat. Nos. 4,949,796, 5,662,181, 5,848,643, 5,647,444, 4,480,703 and 4,312,404, the contents of which are incorporated herein by reference.

Advantageously also the diverter head includes a locking cap located over the housing to hold it in place. More preferably and actuator is mounted in relation to the cap, to release the cap remotely. This arrangement removes the need for an operator to climb the BOP stack to release a clamp to again access to the bowl.

According to a second aspect of the present invention there is provided a bowl for use in a rotatable diverter head, the bowl comprising a substantially cylindrical body having a bore therethrough adapted for receiving a housing, rotatable therein and sealable to a drill pipe passed therethrough, and an inlet flange, the body and flange being rotatably coupled such that the body rotates on a longitudinal axis of the bore when the flange is attached to a blow out preventer stack.

Preferably the body and flange are rotatably coupled by interconnected screw threads on an outer surface of the body and an inner surface of the flange.

Preferably also the flange further includes sealing means to prevent the egress of fluid from the bore through the rotational coupling. The sealing means may be an o-ring or other rubber based seal.

Preferably the flange further includes locking means for preventing rotational movement of the body with respect to the flange when the desired. Advantageously the locking means comprises a locking ring arranged around the body and engageable on the screw threads.

According to a third aspect of the present invention there is provided a method of connecting a rotating diverter head to a return fluid line at a blow out preventer stack, the method comprising the steps:

(a) connecting an inlet flange of the diverter head to an outlet of the blow out preventer stack;

(b) rotating the diverter head with respect to the blow out preventer stack to align a side outlet of the head with a return fluid line; and (c) connecting the side outlet to the return fluid line.

Advantageously the method includes the step of locking the diverter head in position to prevent rotation of the diverter head relative to the blow out preventer after the side outlet is aligned.

Advantageously the method may further include the step of remotely actuating a release mechanism to release a cap of the diverter head to gain access to the spindle.

An example embodiment of the present invention will now be described, by way of example only, with reference to the accompanying drawings of which:

Figure 1:
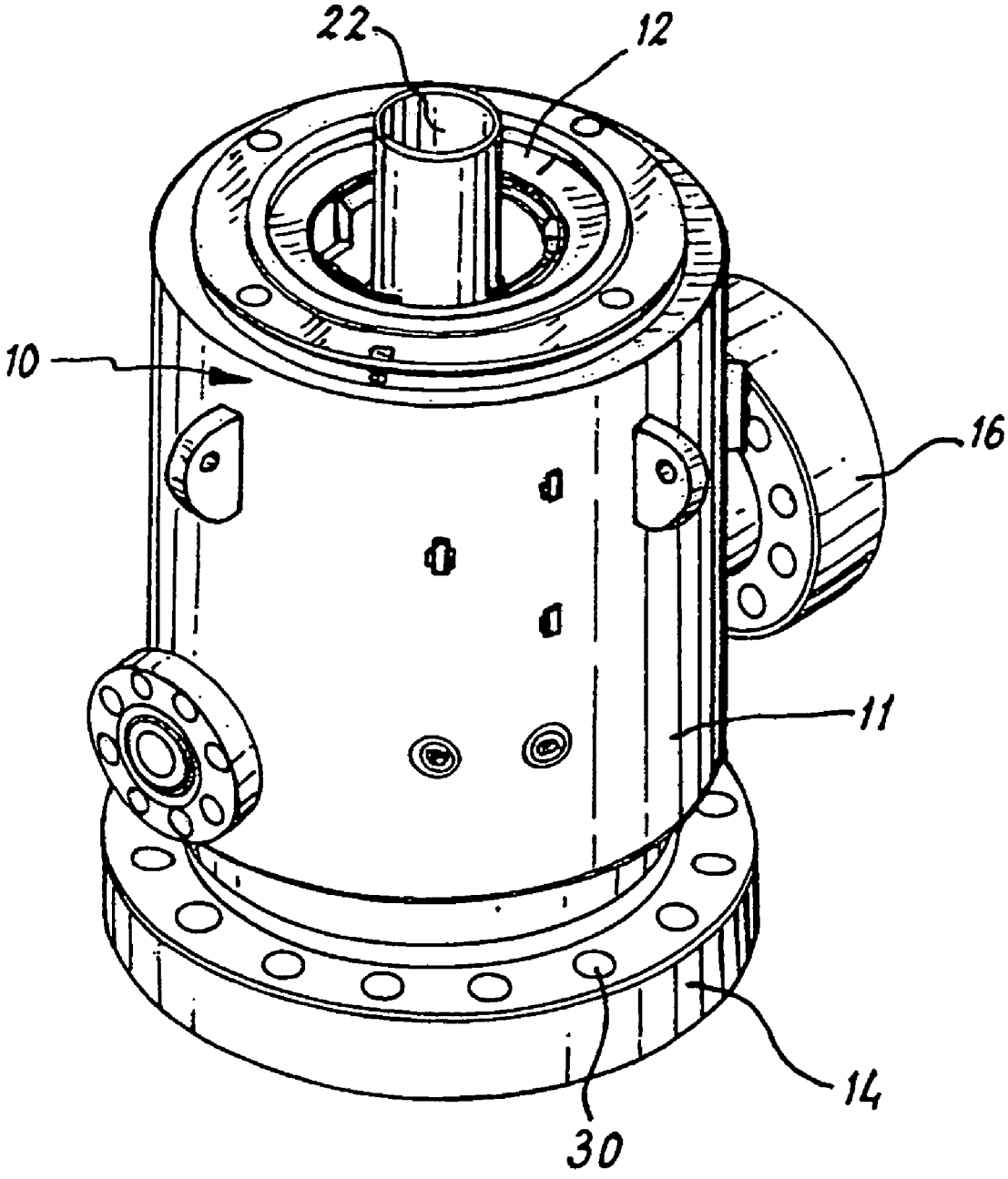
FIG. 1 is an isometric view of a rotating diverter head according to an embodiment of the present invention.
Figure 2:
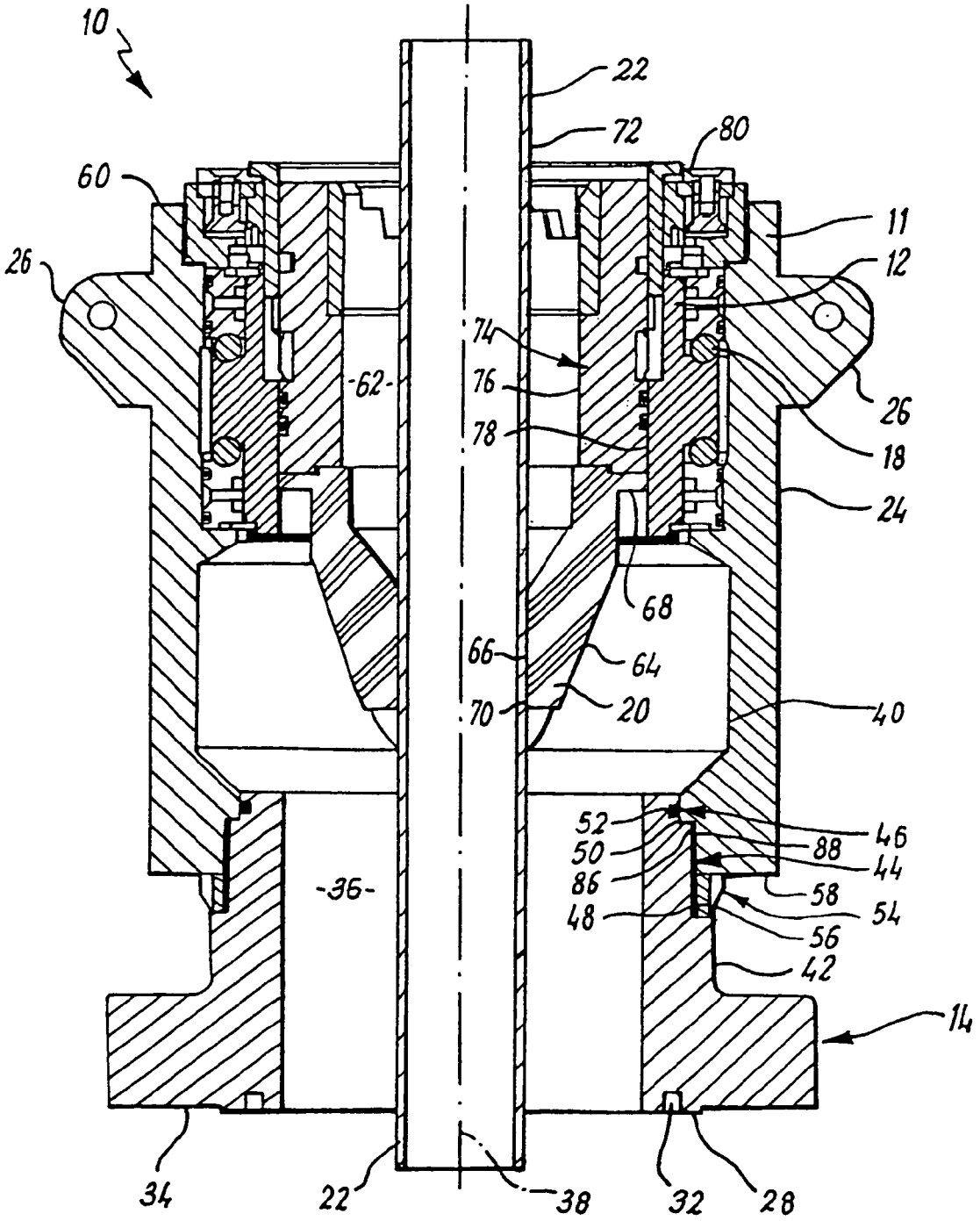
FIG. 2 is a cross sectional view taken vertically through the head of FIG. 1.

Reference is initially made to FIGS. 1 and 2 illustrating a rotating diverter head, generally indicated by reference numeral 10, in accordance with an embodiment of the present invention.

Head 10 includes a bowl 11 which is generally a cylindrical body, a rotating spindle 12, an inlet flange 14 and a side outlet 16. Spindle 12 forms a housing which rotates in anti-friction bearings 18. Spindle 12 also includes a seal 20 which sealably engages a drill pipe 22 located through the head 10.

In the prior art diverter heads these features are found with the bowl and flange typically being of single piece construction and thus referred to as a stationary housing. As can be seen in FIG. 2, the bowl 11 and flange 14 are separate pieces in the present invention. It is the arrangement of the flange 14 and bowl 11 which relate to the present invention and thus the spindle 12 together with its bearing 18 and sealing means 20 may be of any type as is known in the art. For clarity one embodiment of a spindle 12 will be described herein, however recognition that any arrangement of spindle 12 could be used with/in the present invention, will be appreciated.

In the embodiment shown, head 10 comprises a cylindrical body or bowl 11, located upon a flange 14. Bowl 11 has an outer surface 24 upon which are located lugs 26 for lifting and positioning the head 10 on a blow out preventer stack (not shown). Flange 14 has a base 28 compatible with the top flange of the blow out preventer stack and the two are linked via screws located in ports 30. The dimensions of the base 28 of the flange 14 are determined by an international standard to ensure proper mating with other flanges of the same size and pressure rating. Once positioned the flange 14 is fixed in relation to the blow out preventer stack. A seal groove 32 on the bottom face 34 of the base 28 provides for an o-ring to be inserted to prevent the egress of fluid from the head 10 between the base 28 and the blow out preventer stack.

The bowl 11 and flange 14 provide a bore 36 on a central axis 38 through the head 10. The side outlet 16 is arranged to direct fluid in a perpendicular direction from the central bore 36. The bowl 11 and the flange 14 mate between a respective inner surface 40 of the bowl 11 and an outer surface 42 of the flange 14. The inner surface 40 includes a threaded bore 44 and a sealing bore 46. The diameter of sealing bore 46 is less than the diameter of threaded bore 44. The outer surface 42 of flange 14 includes a threaded section 48 and a sealing section 50. The threads of threaded section 48 engage the threads of threaded bore 44 of bowl 11. The sealing section 50 comprises a seal groove 52 into which is located an o-ring or rubber strip (not shown). When the threads of the threaded bore 44 engage the threads on the threaded section 48, the sealing section 50 locates against the sealing bore 46, thus providing sealing engagement between the bowl 11 and the flange 14 to prevent the egress of fluid from the head 10 at this location. The seal will be maintained as the threads are moved relative to each other so that the bowl 11 can rotate on the central axis 38 relative to the flange 14. This rotation is selective and continuous through 360 degrees around the central axis.

Located around the flange 14 is a locking ring 54. Ring 54 is a threaded lock ring which comprises a threaded inner surface 56 that engages threaded section 48 of flange 14. Ring 54 can be rotated upwards towards the base 58 of bowl 11 to prevent movement of the bowl 111 and thus lock the bowl 11 to the flange 14.

Toward an upper end 60 of bowl 11 is located a spindle 12 or housing. Spindle 12 includes a through bore 62 located on the central axis 38. A drill pipe 22 may extend axially through the bore 62. Spindle 12 includes a stripper 64 as is known in the art. Stripper 64 comprises a moulded, resilient seal 20 having a through-hole 66 and a flange 68. The nominal diameter of through-hole 66 is somewhat smaller than the diameter of drill pipe 22 such that the inner surface 70 of the through-hole 66 sealably engages the outer diameter 72 of the drill pipe 22. Spindle 12 further comprises a carrier 74. Carrier 74 has a cylindrical body providing a through-hole 76 concentric to the central axis 38 and an outer surface 78. Flange 68 seals against the carrier 74. At the outer surface 78 of carrier 74 is located a bearing housing 80. Carrier 74 is sealably engaged to bearing housing 80. However, in one or more embodiments the carrier 74 may be disengageable from the bearing housing 80 so that the seal 20 of the stripper 64 can be easily removed from the head 10 for maintenance or replacement. Housing 80 includes anti-friction bearing 18 which allow the bearing housing 80 to rotate within the bowl 11. By their engagement, when housing 80 rotates the stripper 64 and carrier 74 will rotate in a fixed relationship. Thus the spindle 12 can rotate within the bowl 11 while maintaining a seal against the drill pipe 22 passing there through. Thus the drill pipe 22 can rotate or reciprocate unheeded through the head 10. The seal 20 also ensures that fluid travelling up bore 36 is directed through the side outlet 16 for re-circulating down the drill pipe 22.

Figure 3:
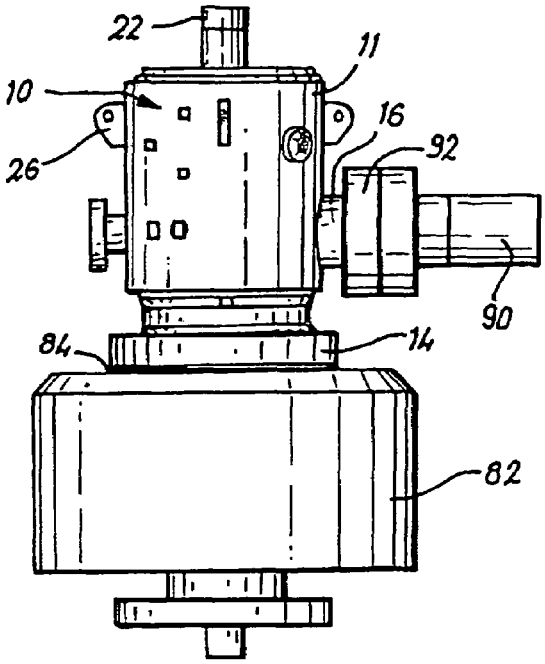
FIG. 3 is a side view of the head of FIG. 1 mounted on the top of a blow out preventer stack.
Figure 4:
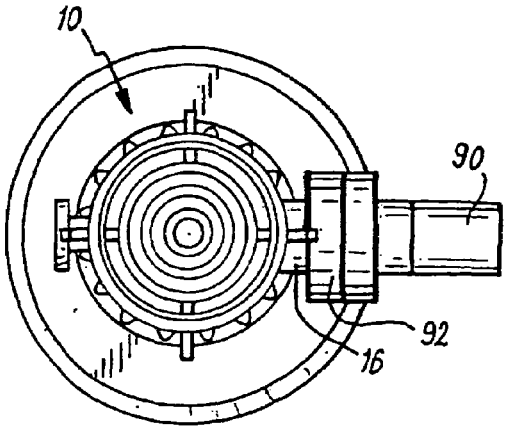
FIGS. 4 and 5 are top views of the head of FIG. 1 illustrating first and second alignment positions of the side outlet.
Figure 5:
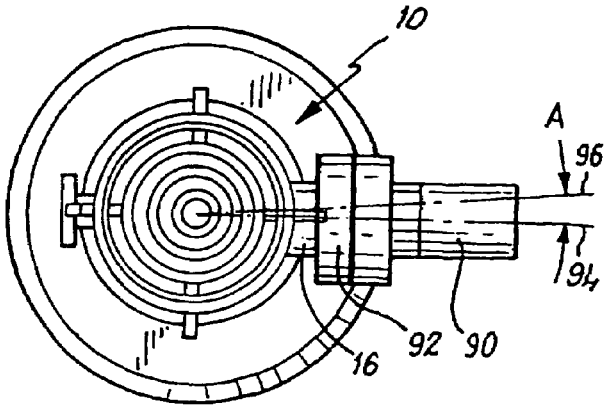

Reference is now made to FIGS. 3 through 5 which illustrate the rotating diverter head 10 in use. To operate, lock ring 54 is threaded onto threaded section 48 of flange 14. Flange 14 is threaded into bowl 11 until face 86 of flange 14 contacts face 88 of bowl 11. Lock ring 54 is threaded until it contacts the base 58 of bowl 11. The rotating diverter head 10 is mounted onto annular blowout preventer 82 of a stack (not shown) using lugs 26 to assist its movement. Head 10 is fixed to blow out preventer 82 by mating flange 14 to outlet flange connection 84 of annular blowout preventer 82 using threaded studs located through ports 30.

A return flow line 90 is attached to an outlet flange 92 of the side outlet 16, as is shown in FIGS. 3 and 5. Flow line 90 is typically a section of fixed piping connected to a separator (not shown). Referring now to FIG. 4, if flow line 90 is not aligned with outlet flange 92, i.e., if the axis 94 of flow line 90 is not co-linear with the axis 96 of outlet flange 92, the head 10 must be rotated about the central axis 38 until the axis 96 of outlet flange 92 is co-linear with the axis 94 of flowline 90.

Rotating diverter head 10 is rotated about its vertical axis on the central axis 38 by unthreading lock ring 54, rotating bowl 11 on the threads of the threaded bore 44 against the threads of threaded section 48 of flange 14, until the axis 96 of outlet flange 92 is co-linear with the axis 94 of flowline 90. Lock ring 54 is then threaded upward and tightened against the base 58 of the bowl 11.

Figure 6:
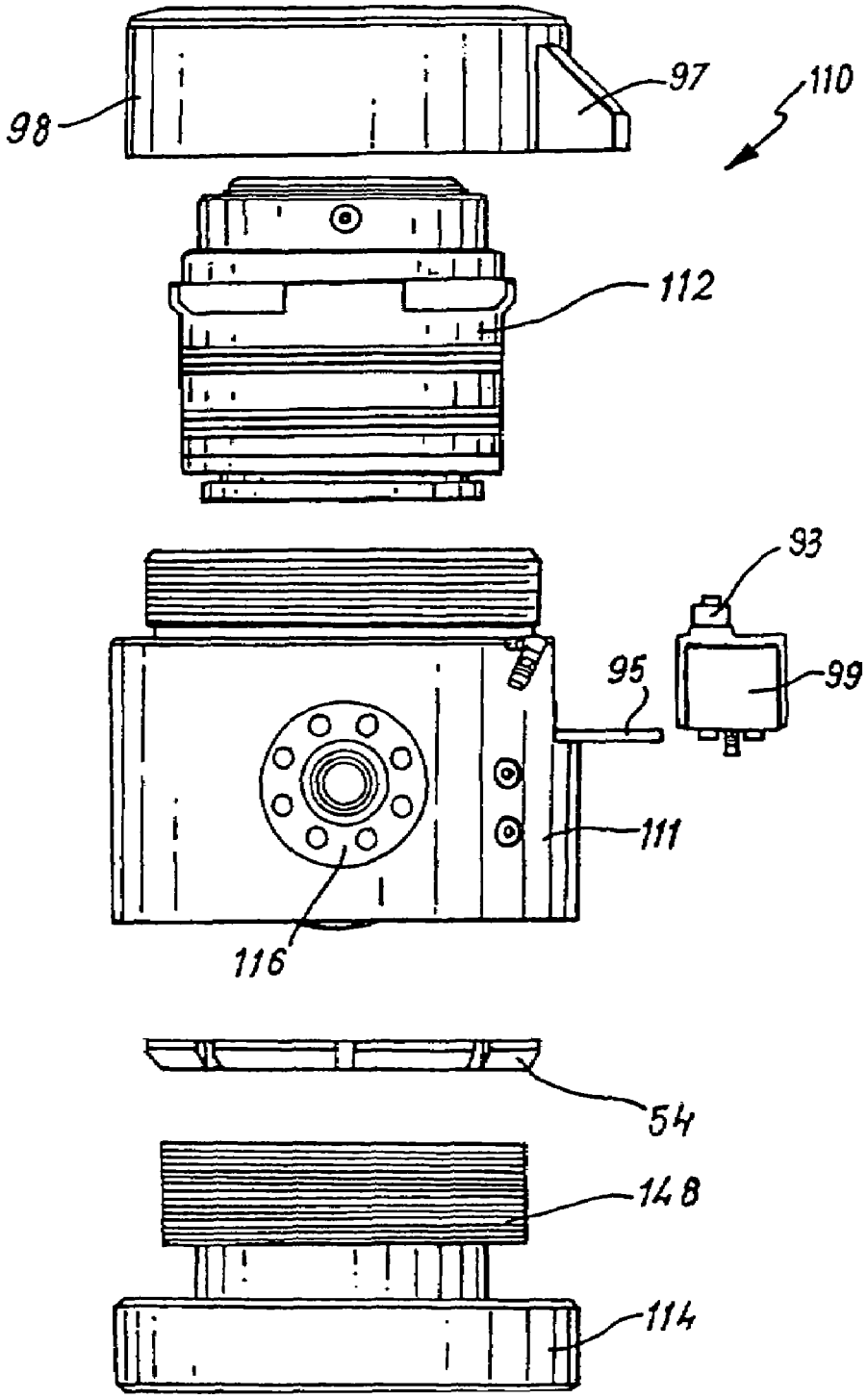
FIG. 6 is an exploded schematic view of a rotating diverter head according to a further embodiment of the present invention.

Reference is now made to FIG. 6 of the drawings which illustrates a rotating diverter head, generally indicated by reference numeral 110, according to a further embodiment of the present invention. Like parts to those of FIGS. 1 to 5 have been given the same reference numeral with the addition of one hundred. Head 110 includes a flange 114 for location on a stack, a bowl 111 into which is located a spindle 112 as in the first embodiment. Head 110 operates in the same manner as in the first embodiment with flange 114 being located on a stack; bowl 111 being rotatable on the flange by virtue of thread 148 and lockable via ring 154; rotation allowing alignment of side outlet 116 with the head 110 in place; and rotation of a drill string available through rotation of spindle 112 in bowl 111. This embodiment further includes a locking cap 98. Locking cap 98 screws onto the bowl 111 while still providing for rotation of spindle 112. The locking cap 98 is in contrast to typical heads on which a clamp is usually mounted to secure spindle 112 in place. Cap 98 includes an extending plate 97.

Bowl 111 includes a surface 95 onto which is located an actuating cylinder 99. Through a shaft 93 of the cylinder contact and consequently movement of plate 97 can be made to release or tighten the cap 98 on the bowl 111. Cylinder 99 can be operated remotely. This feature has the advantage of limiting the need for an operator to climb the BOP stack in order to tighten the spindle 112 against the drill string.

In prior art diverter heads the inlet flange 14, 114 is either welded or otherwise immovably and permanently attached to the bowl 11, 111. This means that the relationship between the inlet flange and the side outlet is fixed preventing movement of the side outlet to aid alignment with a return flow line. Therefore the principle advantage of the present invention is that it provides a rotating diverter head where the side outlet can be re-aligned when the head is connected to a blow out preventer, or other stack.

A further advantage of the present invention is that it provides a diverter head in which the inlet flange may be interchangeable so that the size and pressure rating of the diverter head can be varied without the need to change the spindle.

Modifications may be made to the invention herein described without departing from the scope thereof. For example, the threaded bore and threaded section may be replaced by a pin and groove arrangement. The groove being a spiral into which the pin may travel circumferentially around the inner or outer surface of the flange or bowl, respectively.

The invention claimed is:

1. A rotating diverter head comprising:

a bowl member having a first bore aligned on a central axis therethrough and a second bore located substantially transverse of the central axis;

a housing located substantially within the bowl member including first rotational means to rotate the housing relative to the bowl member and first sealing means to sealably engage the housing upon a drill pipe when the drill pipe is inserted through the first bore; and an inlet flange for connecting the bowl member to a blow out preventer stack, the flange including a second rotational means to selectively rotate the bowl member about the central axis, wherein the second rotational means comprises interconnected screw threads between the flange and the bowl member.

2. The rotating diverter head as claimed in claim 1, wherein the flange includes second sealing means to prevent the egress of fluid from the first bore through the second rotational means.

3. The rotating diverter head as claimed in claim 2, wherein the flange includes locking means for preventing rotational movement of the bowl member with respect to the flange when the second bore is aligned.

4. The rotating diverter head as claimed in claim 2, wherein the head includes a locking cap located over the housing and engageable to the bowl.

5. The rotating diverter head as claimed in claim 1, wherein the flange includes second sealing means to prevent the egress of fluid from the first bore through the second rotational means.

6. The rotating diverter head as claimed in claim 1, wherein the flange includes locking means for preventing rotational movement of the bowl member with respect to the flange when the second bore is aligned.

7. The rotating diverter head as claimed in claim 1, wherein the head includes a locking cap located over the housing and engageable to the bowl.

8. A rotating diverter head comprising:

a bowl member having a first bore aligned on a central axis therethrough and a second bore located substantially transverse of the central axis;

a housing located substantially within the bowl member including first rotational means to rotate the housing relative to the bowl member and first sealing means to sealably engage the housing upon a drill pipe when the drill pipe is inserted through the first bore; and an inlet flange for connecting the bowl member to a blow out preventer stack, the flange including a second rotational means to selectively rotate the bowl member about the central axis wherein the flange includes locking means for preventing rotational movement of the bowl member with respect to the flange when the second bore is aligned.

9. The rotating diverter head as claimed in claim 8 wherein the locking means comprises a locking ring arranged around the bowl member and engageable on screw threads provided between the flange and the bowl member.

10. The rotating diverter head as claimed in claim 9, wherein the head includes a locking cap located over the housing and engageable to the bowl.

11. The rotating diverter head as claimed in claim 8, wherein the head includes a locking cap located over the housing and engageable to the bowl.

12. A rotating diverter head comprising:

a bowl member having a first bore aligned on a central axis therethrough and a second bore located substantially transverse of the central axis;

a housing located substantially within the bowl member including first rotational means to rotate the housing relative to the bowl member and first sealing means to sealably engage the housing upon a drill pipe when the drill pipe is inserted through the first bore, said head including a locking cap located over the housing and engageable to the bowl; and an inlet flange for connecting the bowl member to a blow out preventer stack, the flange including a second rotational means to selectively rotate the bowl member about the central axis.

13. The rotating diverter head as claimed in claim 12 wherein an actuator is mounted on the head to remotely lock and unlock the cap.

14. A bowl for use in a rotatable diverter head, the bowl comprising a substantially cylindrical body having a bore therethrough adapted for receiving a housing, rotatable therein and sealable to a drill pipe passed therethrough, and an inlet flange, the body and flange being rotatably coupled such that the body rotates on a longitudinal axis of the bore when the flange is attached to a blow out preventer stack, wherein the body and the flange are rotatably coupled by interconnected screw threads on an outer surface of the body and an inner surface of the flange.

15. The bowl as claimed in claim 14, wherein the flange includes sealing means to prevent the egress of fluid from the bore through the rotational coupling.

16. The bowl as claimed in claim 14, wherein the flange includes locking means for preventing rotational movement of the body with respect to the flange when desired.

17. A bowl for use in a rotatable diverter head, the bowl comprising a substantially cylindrical body having a bore therethrough adapted for receiving a housing, rotatable therein and sealable to a drill pipe passed therethrough, and an inlet flange, the body and flange being rotatably coupled such that the body rotates on a longitudinal axis of the bore when the flange is attached to a blow out preventer stack, wherein the flange includes locking means for preventing rotational movement of the body with respect to the flange when desired.

18. The bowl as claimed in claim 17 wherein the locking means comprises a locking ring arranged around the body and engageable on screw threads provided between the flange and the bowl member.

19. A method of connecting a rotating diverter head to a return fluid line at a blow out preventer stack, the method comprising the steps:

(a) connecting an inlet flange of the diverter head to an outlet of the blow out preventer stack:

(b) rotating the diverter head with respect to the blow out preventer stack to align a side outlet of the head with a return fluid line;

(c) connecting the side outlet to the return fluid line; and (d) locking the diverter head in position to prevent rotation of the diverter head relative to the blow out preventer after the side outlet is aligned.

20. The method as claimed in claim 19, further including the step of remotely actuating a release mechanism to release a cap on the diverter head to adjust the head against a drill pipe passing therethrough.

21. A method of connecting a rotating diverter head to a return fluid line at a blow out preventer stack, the method comprising the steps:

(a) connecting an inlet flange of the diverter head to an outlet of the blow omit preventer stack:

(b) rotating the diverter head with respect to the blow out preventer stack to align a side outlet of the head with a return fluid line;

(c) connecting the side outlet to the return fluid line, and (d) further including the step of remotely actuating a release mechanism to release a cap on the diverter head to adjust the head against a drill pipe passing therethrough.

22. A bowl for use in a rotatable diverter head, the bowl comprising a substantially cylindrical body having a bore therethrough adapted for receiving a housing, rotatable therein and sealable to a drill pipe passed therethrough, and an inlet flange, the body and flange being rotatably coupled such that the body rotates on a longitudinal axis of the bore when the flange is attached to a blow out preventer stack, said flange including sealing means to prevent the egress of fluid from the bore through the rotational coupling and a locking means for preventing rotational movement of the body with respect to the flange when desired.

* * * * *